US007055347B2

(12) United States Patent
Bruske et al.

(10) Patent No.: US 7,055,347 B2
(45) Date of Patent: Jun. 6, 2006

(54) MODULE FOR TEXTILE MACHINES, ESPECIALLY STITCH-FORMING MACHINES

(75) Inventors: Johannes Bruske, Albstadt (DE); Stefan Danner, Bitz (DE); Walter Kettlitz, Balingen (DE); Norbert Scholz, Winterlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/516,130

(22) PCT Filed: May 24, 2003

(86) PCT No.: PCT/DE03/01693

§ 371 (c)(1),
(2), (4) Date: Nov. 30, 2004

(87) PCT Pub. No.: WO04/001113

PCT Pub. Date: Dec. 31, 2003

(65) Prior Publication Data

US 2005/0183467 A1 Aug. 25, 2005

(30) Foreign Application Priority Data

Jun. 20, 2002 (DE) ..... 102 27 532

(51) Int. Cl.
*D04B 35/02* (2006.01)

(52) U.S. Cl. ..... 66/116; 66/1 R; 66/104

(58) Field of Classification Search ..... 66/1 R, 66/203–208, 116–124, 90, 104
See application file for complete search history.

(56) References Cited

U.S. PATENT DOCUMENTS

| | | | | |
|---|---|---|---|---|
| 2,682,163 A | | 6/1954 | Staff et al. | |
| 3,369,379 A | | 2/1968 | Shepard | |
| 3,823,581 A | | 7/1974 | Russo | |
| 5,878,599 A | * | 3/1999 | Halassek | 66/214 |
| 5,966,969 A | * | 10/1999 | Mista | 66/206 |
| 6,484,541 B1 | * | 11/2002 | Haag | 66/104 |
| 6,912,875 B1 | * | 7/2005 | Fehrenbacher | 66/1 R |

FOREIGN PATENT DOCUMENTS

| | | |
|---|---|---|
| DE | 197 57 962 A1 | 7/1999 |
| DE | 198 03 474 C1 | 9/1999 |
| EP | 0 806 507 A | 5/1975 |
| EP | 0 227 018 A | 7/1987 |

* cited by examiner

*Primary Examiner*—Danny Worrell
(74) *Attorney, Agent, or Firm*—Fitch, Even, Tabin & Flannery; Norman N. Kunitz

(57) ABSTRACT

A module for textile machines has a plurality of tools (2) with retention portions (6). The retention portions are grasped in a plastic body (7), which reaches out or embraces the retention portions (6) at one or more recesses (15, 27, 28). The plastic body serves to fix the tools (2) positionally correctly with respect to one another. The positioning of the tools (2) with respective to a dividing sinker (11), however, is effected by direct contact between the retention portions (6) and the dividing sinker (11). By filling the gaplike interstices, which exist between the retention portions, with plastic, a compact yet lightweight retention region (4) for the module (1) is obtained.

20 Claims, 4 Drawing Sheets

MODULE FOR TEXTILE MACHINES, ESPECIALLY STITCH-FORMING MACHINES

CROSS REFERENCE TO RELATED APPLICATION

This application is the National Stage filing under 35 U.S.C. 371 of International Application No. PCT/DE03/01693, filed May 23, 2004, and claims priority of German Patent Application 102 27 532.7, filed Jun. 20, 2002.

BACKGROUND OF THE INVENTION

In loop-forming machines or other knitting machines, modules are often used that hold a group of special tools. Such modules are often secured as a group in relatively great numbers to a carrier, known as a dividing sinker, and jointly execute an operating motion, such as a reciprocating motion. This puts demands on the module that until now have not been met, or not with complete satisfaction. Such modules must hold the individual tools precisely both with respect to the dividing sinker and to other tools needed for cooperation and with respect to one another. The precision of positioning of the individual tools is significant, especially with fine pitches, or in other words slight tool spacings, for proper function of the tools. This also applies with a view to exact positioning of the tools with respect to the dividing sinker and other tools.

If the textile machine is to attain a high operating speed, it is desirable that the modules have the slightest possible mass, so that the forces of acceleration and braking during the execution of the reciprocating motion will not be allowed to become too great. The precise support of the tools, however, must be preserved, while saving as much weight as possible. Tools that are combined as described into modules are for instance known as closers, guide needles, knives, loopers, reed fingers, hooks, and other tools that are combined on the module to form a comblike structure.

From German Patent DE 19803474 C1, one such comblike structure with a plurality of tines, and a method for producing it, are known. The tines are parallel to and spaced apart from one another. They are each retained by one end between two adhesive bands adhesively bonded to one another and extend away from these bands.

If such a structure is secured to a dividing sinker, the flexibility of the adhesive bands can cause problems. Moreover, the precise relationship between the individual tines and the dividing sinker must be established by way of the adhesive bands.

From German Patent Disclosure DE 19757962 A1, a packet of a plurality of platelike components located side by side and solidly joined together is known. The components have through bores through which a tube reaches. The components are thus threaded, spaced apart from one another, onto one or more tubes. The tube is widened from the inside in a subsequent work step, so that the individual components are seated by positive engagement and non-positive engagement on the tube. They are retained thereby.

With this procedure, it is difficult in producing a packet from individual tools to meet stringent demands for precision, especially if the tools are small.

From German Patent Disclosure DE 19854191 A1, a packet is known comprising a plurality of flat components that are kept parallel to and spaced apart from one another by rods. The rods extend through openings in the platelike components and are of metal, such as chromium nickel steel or carbon steel. An adhesive is proposed for connection purposes between the rods and the tools.

With this structure as well, problems of precision can arise.

SUMMARY OF THE INVENTION

With the above as the point of departure, it is object of the invention to create a module for textile machines that meets stringent demands for precision, has low weight, and can be produced in a rational way.

This object generally is attained according to the present invention by a module having a plurality of tools, which each have one function portion and one retention portion, with the retention portion serving to position the tool on a holder or retainer, such as a dividing sinker, and having at least one recess, which is penetrated by a plastic body. With this module according to the invention, the plastic body combines all the tools into a module which can be manipulated only as a unit. There is no metal-to-metal connection between the retention portions. Nor is there any metal-to-metal connection between the tools. The plastic body has a substantially lower weight than a comparable, alternatively usable metal body. Moreover, the plastic body can hold the individual tools durably and precisely relative to one another. Because it reaches through the recess in the retention portion, a positive engagement can be attained, so that the individual tool does not have to rely solely on the adhesion between plastic and metal, if the tools are of metal.

Preferably, the retention portion of a tool has at least one contact face that is out in the open. This contact face or these contact faces may be used for positioning the module on a dividing sinker. The tools are thus supported directly on the dividing sinker, that is, without the interposition of any other elements, so that if the dividing sinker is embodied precisely and the individual tools are also embodied precisely, precise positioning of the tools on the dividing sinker is also attained. This is especially true if the contact faces of the tools are located in the same plane. This can be attained for instance by providing that all the tools are oriented parallel to one another and in alignment with one another as well as spaced apart from one another.

The retention portion and the function portion of each tool are preferably joined integrally to one another. For example, the tools may be stamped parts or other kinds of metal parts. The integral embodiment of the tools avoids problems of precision in the relative positioning of the retention portion and function portion.

In a preferred embodiment, the tools are joined to one another solely via the plastic body. There is no other connecting means whatever. This creates a simple construction as well as the capability of simple production.

The plastic body is preferably in positive engagement with the tools or alternatively or in addition in material engagement with them. This can be attained by providing the retention portion with one or more recesses, which are located essentially in its central region. If the plastic body penetrates this recess and in the process fits over the edge of the recess, then the plastic body retains the tools by both positive engagement and material engagement. The plastic body can be produced as an injection-molded body. The injection mold may be embodied such that the individual tools remain immovable in the mold, especially at their support portions, until such time as the plastic body is completed. Very precise positioning of the tools can thus be attained. This is especially true if the plastic body does not reach as far as the outer edge of the retention portions, so that the entire edge or nearly the entire edge of the retention portions remains free. The retention portions can be grasped and positioned during the production of plastic body. Alternatively, it may suffice for the retention portions to be grasped and retained on at least two opposed points of its edge.

In an alternative embodiment, one or more recesses open at the edge are provided for the plastic body. This embodiment has the advantage that the plastic body can be produced separately, and the retention portions of the individual tools are then thrust for instance into premolded slits in the plastic body. The continuous part of the plastic body then reaches the inside of the recess and forms the connection among the tools. It is advantageous if recesses provided on two opposed edges of the retention portion form the receptacles for plastic bodies. In this way, a complete module is obtained.

In a further-modified embodiment, the plastic body can have a contact face. This may be advantageous if the special properties of the plastic, such as its internal damping or its elasticity, are to become operative between the dividing sinker and the tools. It is also possible to combined the contact faces of the retention portions with the contact face of the plastic body, so that the retention portions rest at one point on the dividing sinker itself, while at another point they rest indirectly on the dividing sinker via the plastic body.

The plastic body may be constructed of a thermoplastic, a plastic that hardens, a single- or multi-component plastic, or a fiber-reinforced plastic. This depends on the desired production process and on the result to be attained.

Further details of advantageous embodiments of the invention will become apparent from the drawing, the description and dependent claims. In the drawing, exemplary embodiments of the invention are shown.

DETAILED DESCRIPTION OF THE INVENTION

Figure 1:
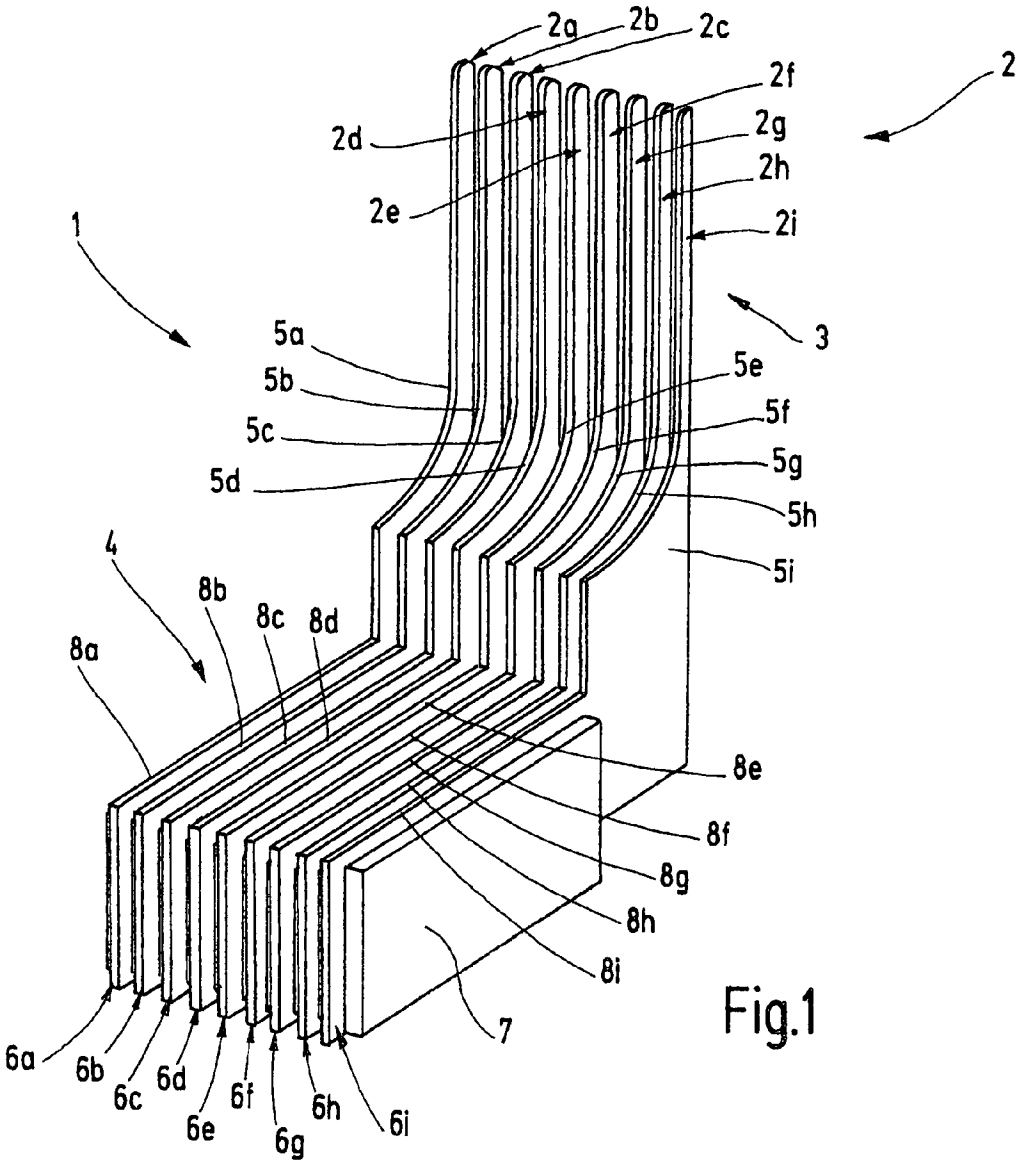
FIG. 1 is a schematic perspective view of a module of the invention.

In FIG. 1, a module 1 is shown which is intended for use in a loop-forming machine. It has a plurality of tools 2. Each individual tool 2*a*, 2*b*, 2*c*, 2*d*, 2*e*, 2*f*, 2*g*, 2*h*, 2*i* is positioned precisely relatively to the other tools 2. In the exemplary embodiment shown in FIG. 1, the tools 2 are closers. However, they may individually also be knives, loopers, reed fingers, hooks, guide needles, or other sorts of tools of the kind needed in textile machines, as long as they execute a common working motion in a constant relative position.

The tools 2 are embodied identically to one another and have a platelike basic shape. In the module, they are retained laterally in alignment with one another and spaced apart parallel from one another, so that they define a comblike function region 3. This region is adjoined by a retention region 4, which serves to secure the module 1 to a suitable carrier, such as a dividing sinker of a loop-forming machine. The tools 2 each have one fingerlike function portion 5*a*, 5*b*, 5*c*, 5*d*, 5*e*, 5*f*, 5*g*, 5*h*, 5*i* and one retention portion 6*a*, 6*b*, 6*c*, 6*d*, 6*e*, 6*f*, 6*g*, 6*h*, 6*i*. The function portions 5 are each joined integrally to the respective retention portions 6. The tools 2 are formed for instance by stamped parts.

The retention portions 6 are joined to one another via a plastic body 7, which inseparably joins the tools 2 to one another. The plastic body 7 is embodied such that it penetrates all the retention portions 6, but leaves their respective edge 8*a*, 8*b*, 8*c*, 8*d*, 8*e*, 8*f*, 8*g*, 8*h*, 8*i* free at least in some portions, or in other words does not reach that edge. As a result, the narrow edges 8*a*, 8*b*, 8*c*, 8*d*, 8*e*, 8*f*, 8*g*, 8*h*, 8*i* form contact faces for positioning the tools of a module on a dividing sinker. The contact faces are all located in the same plane and thus jointly form the (subdivided) contact face of the retention region 4.

Figure 3:
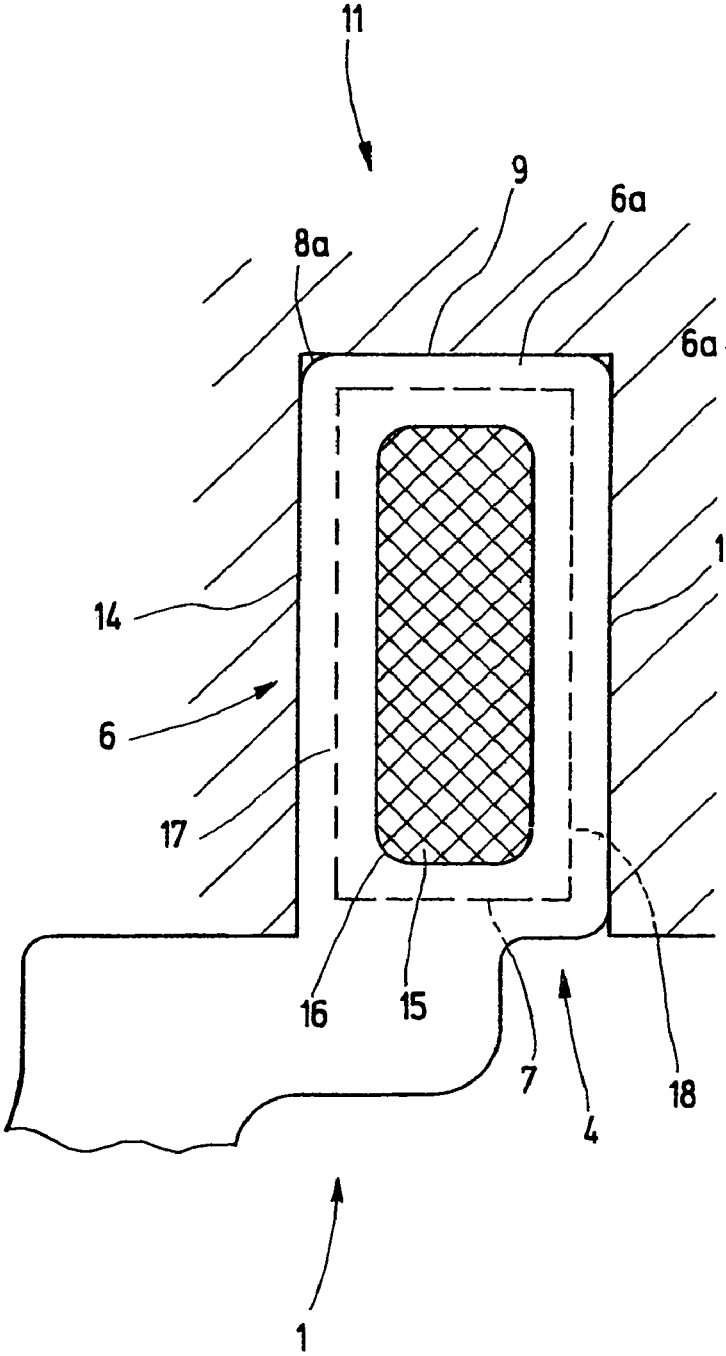
FIG. 3 is a section of the module of FIG. 2, taken along the line III—III.
Figure 2:
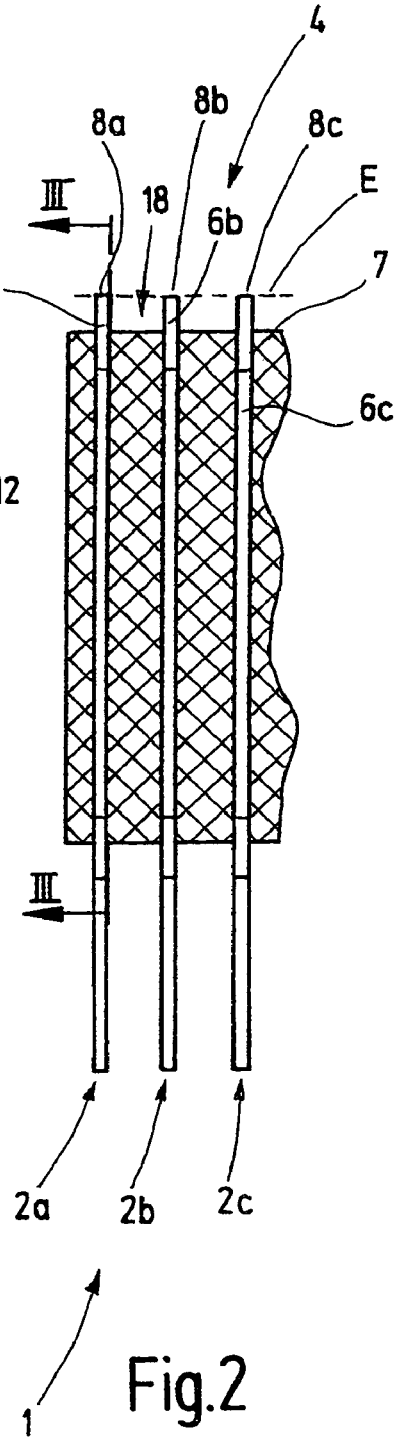
FIG. 2 is a detail in plan view of the module of FIG. 1.

The construction of the retention region 4 can be seen particularly from FIGS. 2 and 3. In FIG. 2, the plastic body 7 and the tool 2*a*, 2*b* and 2*c* are shown. As can be seen, the edges 8*a*, 8*b*, 8*c* are located in the same plane E, so that as FIG. 3 shows, they can rest on a level face 9 of a schematically represented dividing sinker 11. The same is true for regions of the edges 8*a*, 8*b*, 8*c* on the long narrow sides of the retention portions 6. These, too, are disposed each in a respective common plane and are in contact with contact faces 12, 14 of the dividing sinker 11. The retention portion 6*a*, which in side view is approximately rectangular, has a central opening 15, also preferably approximately rectangular, in the form of an elongated opening that is surrounded by an edge 16. This edge, with the outer edge 8*a*, encloses a strip 17 of preferably constant width.

The plastic body 7 extends through the opening 15 and fits over the edge 16 of the opening 15 on both flat sides. As a result, the strip 17 is sunk to approximately half its depth into the plastic body 7. As FIG. 2 particularly shows, this creates groovelike interstices 18 between adjacent retention portions 6*a*, 6*b*. The plastic body 7 has an approximately rectangular cross section, so that the interstice 18 extends along the entire edge 8 of the respective retention portion 6*a* and 6*b*. The same is correspondingly true for all the other retention portions 6.

If the retention region 4, as FIG. 3 schematically shows, is disposed in a dividing sinker 11 and firmly clamped, then the positioning of the retention region 4 and thus of the module 1 is attained by means of the virtually linear contact of the various edges 8*a*, 8*b*, 8*c*, 8*d*, 8*e*, 8*f*, 8*g*, 8*h*, 8*i* with the contact faces 9, 12, 14. The result is high pressures per unit of surface area here, and consequently high positioning certainty. If needed, one or more protrusions may be provided on the contact faces 9, 12, 14, the protrusions engaging the interstices 18 in order to effect a lateral positioning of the module 1.

Figure 5:
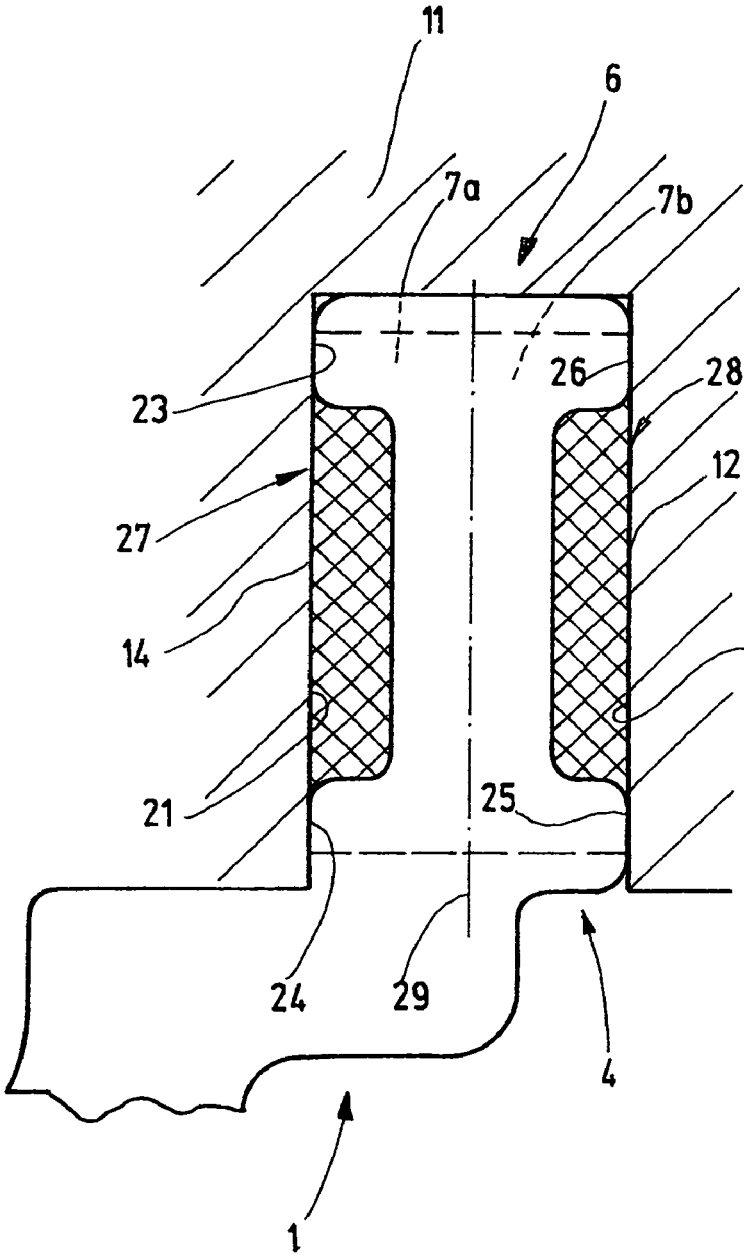
FIG. 5 is a section through the module of FIG. 4, taken along the line V—V.
Figure 4:
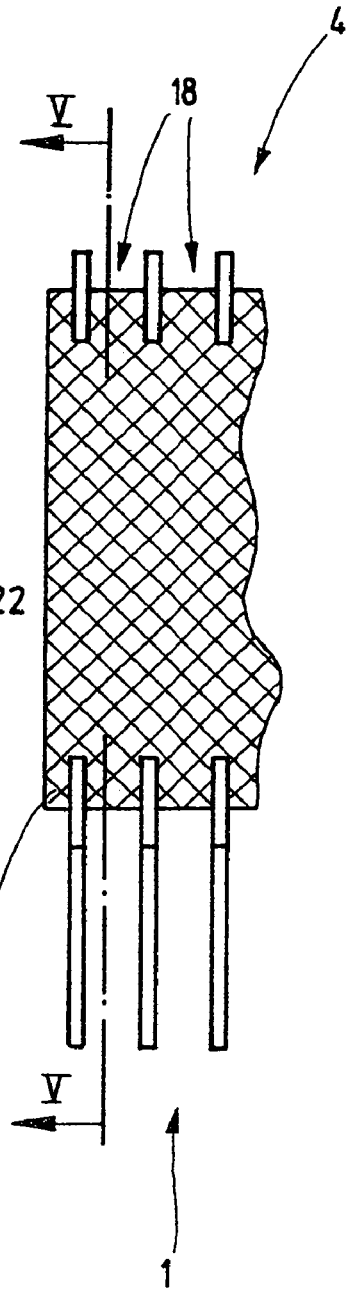
FIG. 4 is a detail in plan view of a modified embodiment of the module.

FIGS. 4 and 5 illustrate a modified embodiment of the module 1. Unless explained separately below, this module matches the module of FIGS. 1 through 3. Where the same reference numerals are used, the above description applies.

Unlike the module described above, the module of FIGS. 4 and 5, in its retention region 4, has a plastic body 7 which does not embrace the retention portions 6 at a central opening but rather at their respective edges 8*a*, 8*b*, 8*c*, 8*d*, 8*e*, 8*f*, 8*g*, 8*h*, 8*i*. The plastic body 7 extends as far as the contact faces 12, 14; that is, its outer faces 21, 22 are in alignment with the edge portions 23, 24, 25, 26 of the retention portions 6. Between the edge portions 23, 24 on one side and 25, 26 on the other along the long narrow sides of the retention portions 6, respective recesses 27, 28 are provided, in the form of indentations which may for instance have a rectangular outline and which are open at the edge. The recesses 27, 28 are filled by corresponding portions of the plastic body 7, which otherwise essentially covers the flat sides of the retention portions 6. On the narrow side, interstices 18 may in turn remain between the retention portions 6, so as to promote the positioning in the dividing sinker 11. As in the previous exemplary embodiment, the retention portions 6 are retained in the plastic body 7 both by positive engagement and material engagement, as a result of the adhesion between the fundamental material comprising the plastic body 7 and the metal comprising the retention portions 6. If needed, the plastic body 7 may also be set back behind the planes defined by the edge portions 23, 24 on one side and 25, 26 on the other, so that it does not touch the contact faces 12, 14. However, it may also protrude very slightly, for instance by only a few hundredths of a millimeter, past these planes defined by the edge portions 23, 24 and 25, 26, so that by its inherent elasticity it reinforces a resilient clamping action.

Instead of a single compact plastic body 7, it is also possible for two partial bodies 7*a*, 7*b* to be provided, which for instance at a center line 29 abut one another, are adjoined to one another, or define a gap with one another here. The plastic bodies 7*a*, 7*b* may be prefabricated and can be attached to the retention portions 6 in an assembly operation. Fixation can be done by heat, adhesive, or frictional engagement.

Figures 6, 7:
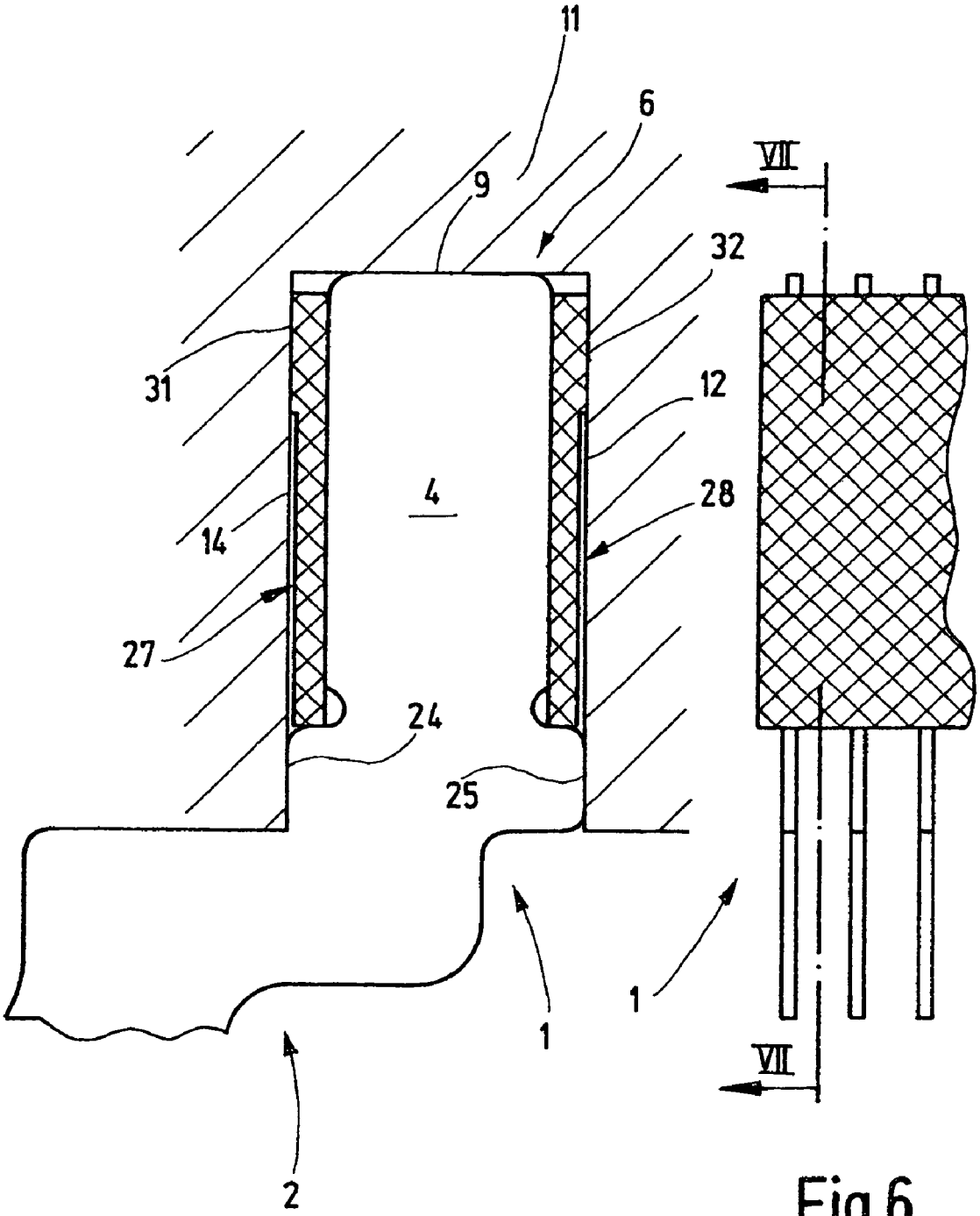
FIG. 6 is a detail in plan view of a further modified embodiment of the module.
FIG. 7 is a section through the module of FIG. 6, taken along the line VII—VII.

A further embodiment of the invention is shown in FIGS. 6 and 7. While in the embodiments described above the positioning of the module 1 on the dividing sinker 11 is effected solely by direct contact between the retention portions 6 and the contact faces 9, 12, 14, in the exemplary embodiment described above, a different principle has been chosen:

In the modules of FIGS. 6 and 7, the recesses 27, 28 are widened in such a way that the edge portions 23, 26 of the retention portions 6 are omitted. What remain are the edge portions 24, 25, which are in direct contact with the contact faces 12, 14. Moreover, the retention portions 6 are, with their narrow side, in direct contact with the contact face 9. Thus as in all the embodiments described above, the retention portions 6 are in the open on three sides of the retention region 4, specifically on the two opposed flat sides of the retention portion 4 as well as on the narrow side facing away from the tools 2. Moreover, the plastic body 7 extends through the recesses 27, 28, and contact faces 31, 32 are embodied on the plastic body 7 that replace the edge portions 23, 26 of the module 1 of FIG. 5. The contact faces 31, 32 are disposed on the flat sides of the retention region 4 in the immediate vicinity of its narrow side.

The contact faces 31, 32 protrude somewhat past the rest of the plastic body 7. If for instance a tough-resilient plastic, which has inherent resilience and damping properties, then the module 1 can in this way be supported precisely by direct metal-to-metal contact between the retention portions 6 and the dividing sinker 1. Because of the resilience that is inherent to the plastic and that can be especially utilized by embodying the contact faces 31, 32 as narrow strips, high invulnerability to tolerances of the module 1 relative to the dividing sinker 11 is moreover obtained. If the plastic is considered to be resilient, then the edge portions 24, 25 and the edge 8 form a three-point contact in the upper end region, on the narrow side, of the retention region 4.

As in the exemplary embodiment described above, the plastic body 7 may be embodied in one piece or may comprise two parts, which are thrust onto the retention portions 6 from the long narrow sides of the retention portions. The fixation can be done by material engagement, by means of adhesive, or by frictional engagement. This last type has the advantage of allowing dismantling again.

Further advantageous embodiments and modifications are possible. For instance, the edge 8 of the module of FIGS. 2 and 3 may be provided with one or more recesses, to reduce the area of contact between the edge 8 and the contact faces 9, 12, 14. Moreover, the retention portions 6 in the embodiments of FIGS. 4 through 7 may be provided with openings through which the plastic body 7 extends. As a result, an even more intimate bond between the plastic and the tools 2 can be attained.

A module for textile machines has a plurality of tools 2 with retention portions 6. The retention portions are grasped in a plastic body 7, which reaches out or embraces the retention portions 6 at one or more recesses 15, 27, 28. The plastic body serves to fix the tools 2 positionally correctly with respect to one another. The positioning of the tools 2 with respective to a dividing sinker 11, however, is effected by direct contact between the retention portions 6 and the dividing sinker 11. By filling the gaplike interstices, which exist between the retention portions, with plastic, a compact yet lightweight retention region 4 for the module 1 is obtained.

LIST OF REFERENCE NUMERALS

1 Module
2 Tools
2*a* through 2*i* Tool
3 Function region
4 Retention region
5 Function portions
5*a* through 5*i* Function portion
6 Retention portions
6*a* through 6*i* Retention portion
7, 7*a*, 7*b* Plastic bodies
8*a* through 8*i* Edge
9 Contact face
11 Dividing sinker
12, 14 Contact face
15 Recess
16 Edge
17 Strip
18 Interstice
21, 22 Outer faces
23, 24, 25, 26 Edge portions
27, 28 Recesses
29 Center line
31, 32 Contact faces
E Plane

The invention claimed is:

1. A module for textile machines comprising:

a plurality of tools, which each have a function portion, and a retention portion with substantially flat side faces, with the retention portions each having at least one recess; and, a plastic body in which at least parts of the retention portions are embedded and which penetrates the recesses and extends over and covers at least a portion of the flat side faces of the extension portions of the tools.

2. The module of claim 1, wherein the retention portion of at least one tool has at least one edge contact face for contacting an external support, which contact face is located in the open.

3. The module of claim 1, wherein the tools are retained parallel to one another, in alignment with one another, and spaced apart from one another.

4. The module of claim 1, wherein the tools are embodied identically.

5. The module of claim 1, wherein the respective retention portions and function portions are joined integrally to one another.

6. The module of claim 1, wherein the tools are joined to one another by the plastic body.

7. The module of claim 1, wherein the tools are joined to one another solely via the plastic body.

8. The module of claim 1, wherein the plastic body is in positive engagement with the tools.

9. The module of claim 1, wherein the plastic body is in material engagement with the tools.

10. The module of claim 1, wherein the recess provided in the respective retention portions penetrates the retention portions centrally.

11. The module of claim 10, wherein the recess has a closed edge adjoining its entire circumference.

12. The module of claim 1, wherein the plastic body is an injection-molded body.

13. The module of claim 1, wherein the recess is open at the edge face of the retention portion.

14. The module of claim 1, wherein recesses open at the edge face are embodied on two opposed edge faces of the retention portion.

15. The module of claim 1, wherein the plastic body fills the entire recess and protrudes past its edge, but at least at some points does not reach the outer edge faces of the retention portions.

16. The module of claim 1, wherein the plastic body protrudes past the outer edge face of the retention portions of the tools at at least one point.

17. The module of claim 1, wherein at least one contact face for the module with a support is embodied on the plastic body.

18. The module of claim 1, wherein the contact faces for the module with a support are embodied on both the retention portions and the plastic body.

19. The module of claim 1, wherein the plastic body is constructed of a fiber-reinforced plastic.

20. The module of claim 1, wherein the textile machine is a loop-forming textile machine.

* * * * *